US007682128B2

(12) United States Patent
Kinzer

(10) Patent No.: US 7,682,128 B2
(45) Date of Patent: Mar. 23, 2010

(54) AXIAL FAN HAVING ADJUSTABLE BLADES AND METHOD OF MOUNTING THE BLADES

(75) Inventor: Frank Kinzer, Merchweiler (DE)

(73) Assignee: TLT-TURBO GmbH (DE)

( * ) Notice: Subject to any disclaimer, the term of this patent is extended or adjusted under 35 U.S.C. 154(b) by 577 days.

(21) Appl. No.: 11/638,605

(22) Filed: Dec. 13, 2006

(65) Prior Publication Data

US 2007/0151385 A1 Jul. 5, 2007

(30) Foreign Application Priority Data

Dec. 15, 2005 (DE) ..... 10 2005 060 433

(51) Int. Cl.
*F04D 29/36* (2006.01)

(52) U.S. Cl. ..... 415/147; 416/168 R

(58) Field of Classification Search ..... 416/147, 416/168 R

See application file for complete search history.

(56) References Cited

U.S. PATENT DOCUMENTS 2,107,785 A * 2/1938 Grabarse et al. ..... 416/135
4,630,999 A 12/1986 De La Harpe
7,229,250 B2 6/2007 McCallum et al.

FOREIGN PATENT DOCUMENTS

DE 3214223 10/1983
DE 3812227 4/1988
DE 4315080 A1 * 11/1994
FR 1189060 9/1959

* cited by examiner

*Primary Examiner*—Igor Kershteyn
(74) *Attorney, Agent, or Firm*—Robert W. Becker; Robert Becker & Assoc.

(57) ABSTRACT

An axial fan comprising an impeller provided with a supporting ring on which is disposed an adapter. Spindles are rotatably mounted in the supporting ring, and adjustable blades are connected to the spindles. A support is provided for each spindle and is comprised of a roller bearing that rests against an inner side of the supporting ring, and of a bushing that rests against an inner side of the adapter. A tubular nut is threaded onto the outer end of the spindle to fix it in the supporting ring.

4 Claims, 3 Drawing Sheets

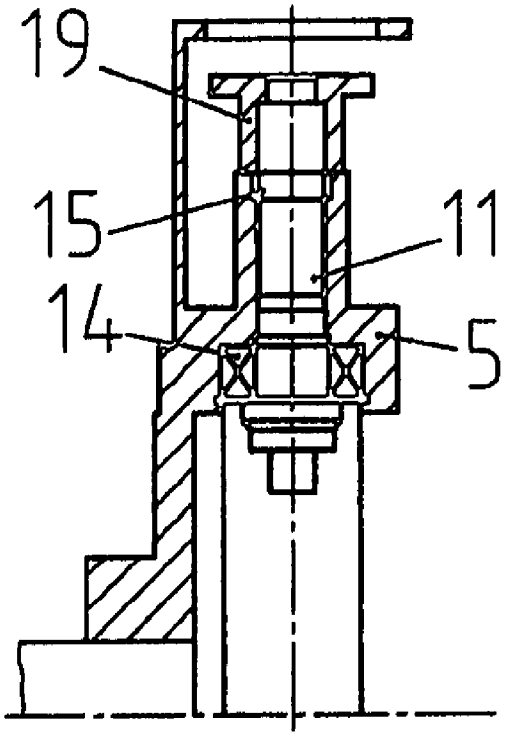
Fig.2.3
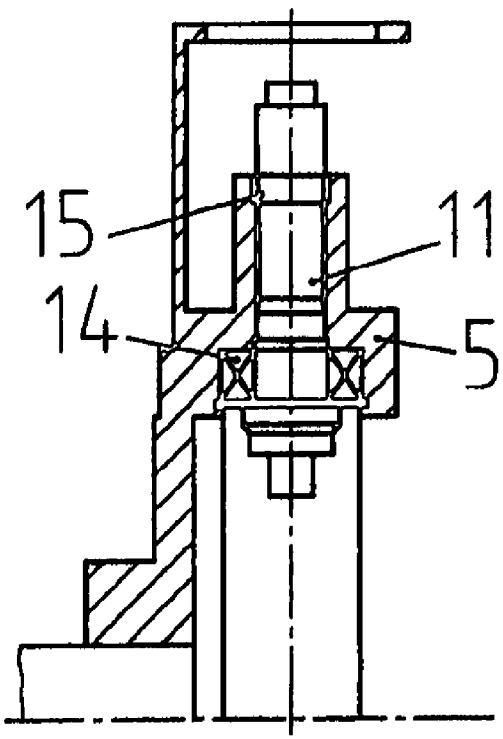
Fig.2.2
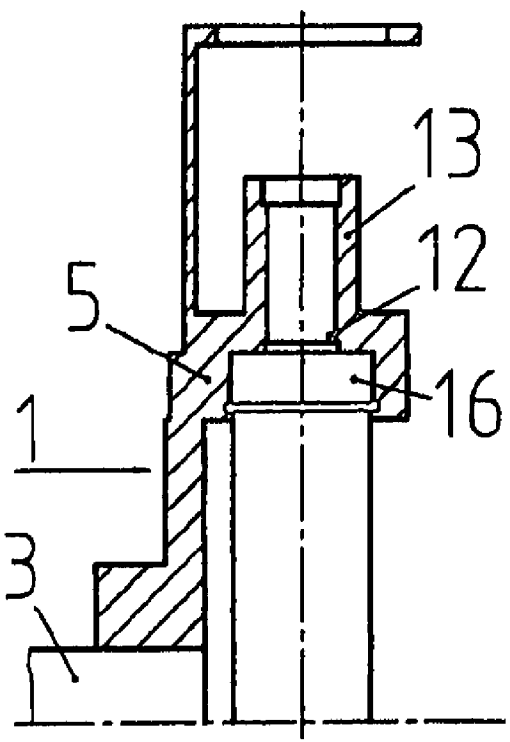
Fig.2.1

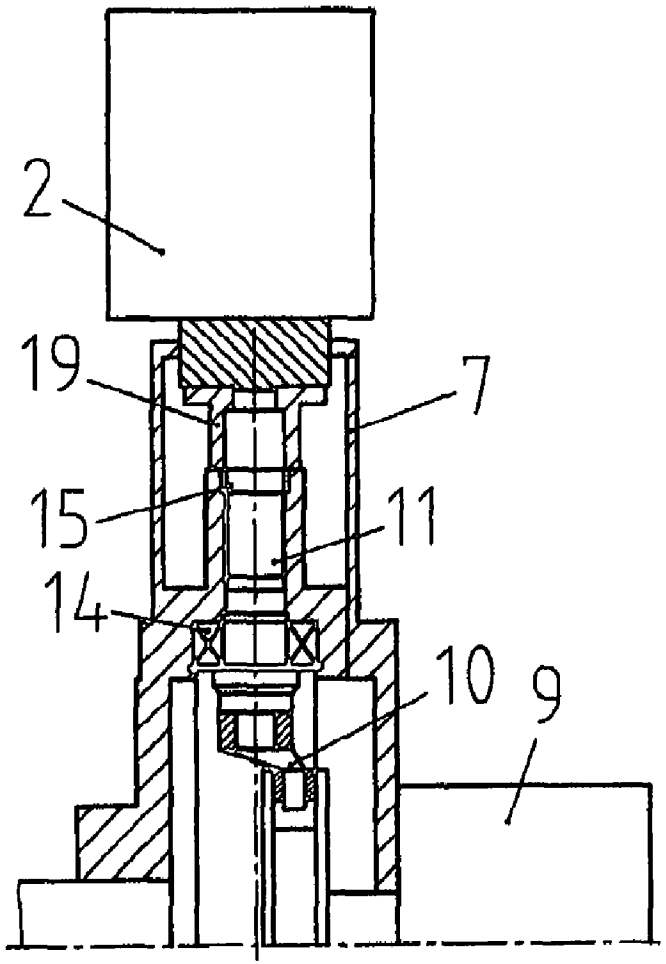
Fig.2.5
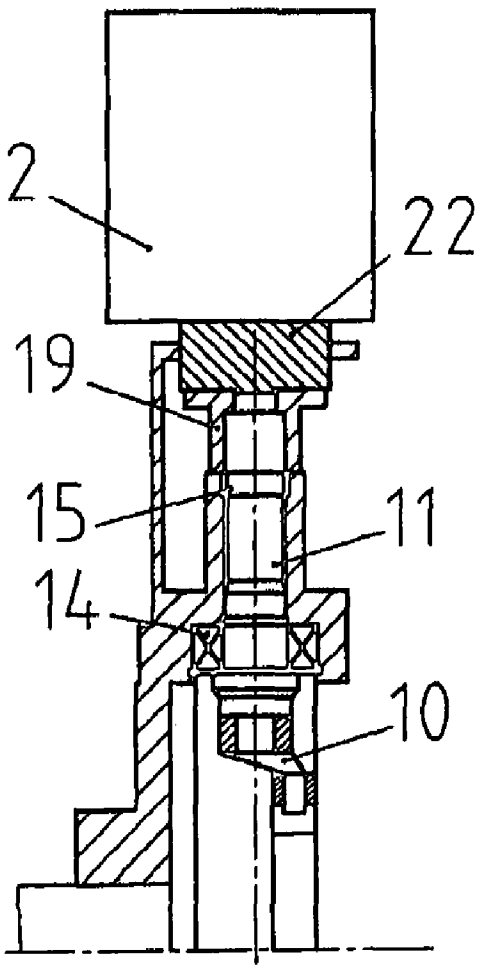
Fig.2.4

AXIAL FAN HAVING ADJUSTABLE BLADES AND METHOD OF MOUNTING THE BLADES

The instant application should be granted the priority date of Dec. 15, 2005 the filing date of the corresponding German patent application 10 2005 060 433.1

BACKGROUND OF THE INVENTION

The present invention relates to an axial fan having an impeller and adjustable blades as well as to a method of mounting the blades.

Modern axial fans are work machines that can be regulated and that convert mechanical energy into kinetic energy. The regulation of the axial fans is effected by the speed or the angle of the position of the blades. If the position of the blades is to be altered during operation, the blades must be secured to a supported shaft, a spindle. Previously, such a spindle was placed into the impeller from the outside and threadedly fastened from the inside. Such a manner of operation is relatively complicated and requires various components.

It is an object of the present invention to simplify the construction of the spindle mounting of an axial fan of the aforementioned general type and hence to make it more economical.

SUMMARY OF THE INVENTION

This object is realized by an axial fan that comprises: an impeller that is provided with a supporting ring; an adapter disposed on the supporting ring; spindles rotatably mounted in the supporting ring; adjustable blades connected to the spindles; support means for each spindle comprised of a roller bearing that rests against an inner side of the supporting ring, and of a bushing that rests against an inner side of the adapter; and a tubular nut that is adapted to be threaded onto the outer end of the spindle for fixing the spindle in the supporting ring. The object is furthermore realized by a method for mounting the blades of the axial fan, and includes the steps of successively slipping the roller bearing onto the spindle, securing the bushing in the adapter of the supporting ring, inserting the spindle, together with the roller bearing, into the supporting ring from within the impeller, and threading the tubular nut from the outside onto the spindle.

The inventive construction of the spindle mounting permits assembly of the spindles and blades of the axial fan from within the impeller. In addition to the fixation of the spindle support in the supporting ring, the threaded connection or fixation of the spindle that is to be carried out from the outside makes it possible to secure the blades directly on the tubular nuts. The overall number of components that are required for the spindle mounting are reduced, as are the processing and assembly expenditures.

BRIEF DESCRIPTION OF THE DRAWINGS

One embodiment of the invention is explained in greater detail in the following and is illustrated in the drawings, in which.

DESCRIPTION OF SPECIFIC EMBODIMENTS

Figure 1:
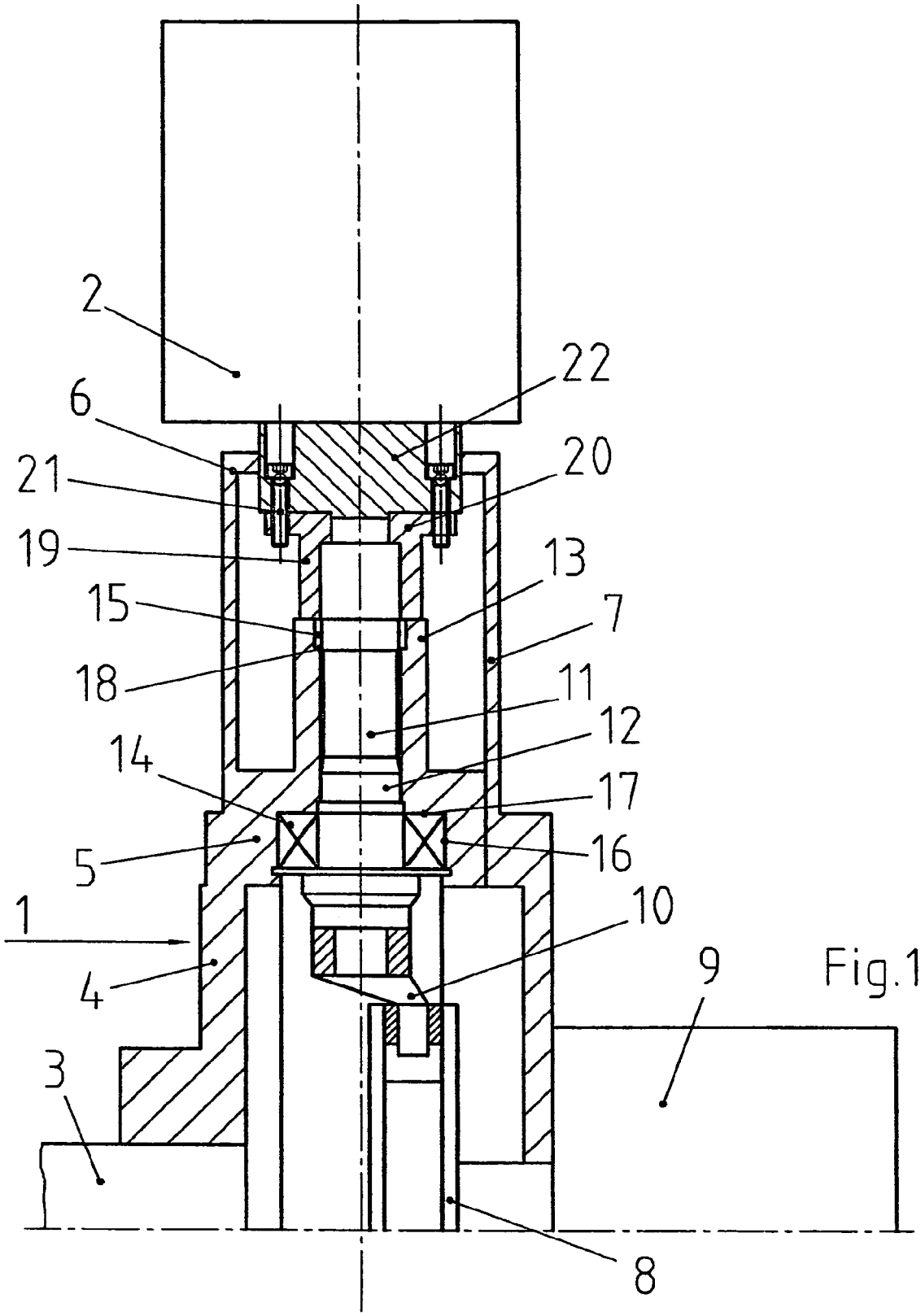
FIG. 1 is a longitudinal cross-sectional view through an axial fan pursuant to the invention, and FIGS. 2.1 to 2.5 are longitudinal cross-sectional views through an axial fan showing the sequence of successive assembly steps.

Referring now to the drawings in detail, the axial fan contains an impeller 1 having adjustable blades 2. The impeller 1 is secured to a shaft 3 and comprises a hub 4, a supporting ring 5, a covering 6 and a cover 7.

Disposed in the interior of the hub 4 is an adjustment disk 8, which is displaceable in the longitudinal direction of the axial fan by means of a hydraulic adjustment mechanism 9. The adjustment mechanism 9 is known and is not the subject matter of the invention, so that a detailed description is dispensed with.

The adjustment disk 8 is provided with a circumferential groove into which offset or angled levers 10 engage. Each lever 10 is connected with a spindle 11, which is rotatably mounted in the supporting ring 5. Upon displacement of the adjustment disk 8, the spindles 11 are rotated by the levers 10 about their longitudinal axes.

One of the blades 2 is secured to each spindle 11 in the following manner. The position of the blades 2 can be altered by the adjustment disk 8 and the adjustment mechanism 9.

The adjustable blades 2 require a special, slightly pitched mounting. For this purpose, each spindle 11 is guided through a radial bore 12 in the supporting ring 5 and through an extension or adapter 13 that is disposed in line with the bore 12. The support of the spindle 11 in the supporting ring 5 and in the adapter 13 is comprised of a roller bearing 14 and a sleeve or bushing 15. The roller bearing 14 is accommodated by an enlarged area 16 of the bore 12 at the radially inner edge of the supporting ring 5. The enlarged area 16 of the bore 12 forms a shoulder 17 against which the roller bearing 14 rests on the inside of the supporting ring 5. Provided in the radially outer end of the adapter 13 of the supporting ring 5 is a recessed area 18 for the bushing 15 of the spindle support. Within this recessed area 18, the outside of the bushing 15 rests against the adapter 13.

The outer end of the spindle 11 projects out of the adapter 13 of the supporting ring 5 and is provided on this portion with a thread. Threaded into or onto the thread of the spindle 11 is a tubular nut 19 which is provided with a flange 20 having an inner and an outer edge. In the threaded-in state, an end face of the tubular nut 19 is supported against the adapter 13 of the supporting ring 5. The tubular nut 19 thus fixes the support of the spindle 11 in the supporting ring 5.

Each blade 2 is connected directly with the tubular nut 19. In this connection, screws 21 are threaded through a base 22 of the blade 2 into the tubular nut 19.

The described principle of construction of the spindle mounting is based on being able to insert the spindle 11 into the supporting ring 5 from within during the assembly of the impeller 1.

In FIG. 2.1, the impeller 1 is shown without spindle 11 and blades 2. Proceeding from here, first the roller bearing 14 is slipped onto the spindle 11, and a bushing 15 is glued into the adapter 13 of the supporting ring 5.

The spindle 11, along with the roller bearing 14, is subsequently placed from the inside into the supporting ring 5 and is prevented from falling out inwardly by a retaining ring and via a sealing cover (FIG. 2.2).

The tubular nut 19 is placed on from above and is threaded directly with the spindle 11 (FIG. 2.3).

The blades 2 are connected by screws 21 to the tubular nut 19 (FIG. 2.4). The further assembly of the impeller 1 is thereafter effected by connecting the lever 10 with the spindles 11, and the cover 7 and the adjustment mechanism 9 are disposed on the impeller 1 (FIG. 2.5).

The specification incorporates by reference the disclosure of German priority document 10 2005 060 433.1 filed Dec. 15, 2005.

The present invention is, of course, in no way restricted to the specific disclosure of the specification and drawings, but also encompasses any modifications within the scope of the appended claims.

The invention claimed is:

1. An axial fan, comprising:

an impeller that is provided with a supporting ring;

an adapter disposed on said supporting ring;

spindles that are rotatably mounted in said supporting ring;

adjustable blades that are connected to said spindles;

means for suporting each spindle comprised of a roller bearing that rests against an inner side of said supporting ring, and of a bushing that rests against an inner side of said adapter; and a tubular nut that is adapted to be threaded onto an outer end of said spindle for fixing said spindle in said supporting ring, wherein a base of each blade is secured directly to said tubular nut.

2. An axial fan, comprising:

an impeller that is provided with a supporting ring;

an adapter disposed on said supporting ring;

spindles that are rotatably mounted in said supporting ring;

adjustable blades that are connected to said spindles;

means for supporting each spindle in said supporting ring and comprised of a roller bearing and a bushing, wherein said roller bearing rests against an inner side of said supporting ring, and wherein said bushing rests against an inner side of said adapter; and a tubular nut that is adapted to be threaded onto an outer end of said spindle for fixing said spindle in said supporting ring, wherein said outer end of said spindle projects out of said adapter and is provided with a thread for receiving said tubular nut.

3. A method for mounting said blades of the axial fan of claim 1, including the steps of successively:

slipping said roller bearing onto said spindle;

securing said bushing in said adapter of said supporting ring;

inserting said spindle, together with said roller bearing slipped thereon, into said supporting ring from within said impeller;

threading said tubular nut from the outside onto said spindle and connectina a base of a blade with said tubular nut by means of screws.

4. An axial fan according to claim 2, wherein a base of each blade is secured directly to said tubular nut.

* * * * *